US005611585A

United States Patent [19]

Lingen

[11] Patent Number: 5,611,585

[45] Date of Patent: Mar. 18, 1997

[54] VACUUM LIFTING PLATE

[76] Inventor: Paul Lingen, Grefratherstrasse 42, D-47669 Wachtendonk/Wankum, Germany

[21] Appl. No.: 377,119

[22] Filed: Jan. 23, 1995

[30] Foreign Application Priority Data

Jan. 22, 1994 [DE] Germany ..... 44 01 870.3

[51] Int. Cl.[6] ..... B66C 1/02

[52] U.S. Cl. ..... 294/64.1; 294/65; 414/737

[58] Field of Search ..... 294/64.1, 65; 901/40; 414/627, 737, 752; 271/90, 94, 98, 103

[56] References Cited

U.S. PATENT DOCUMENTS

| | | | |
|---|---|---|---|
| 1,842,383 | 1/1932 | Bell | 294/64.1 |
| 2,233,350 | 2/1941 | Nelson | 294/65 |
| 2,920,916 | 1/1960 | Pagdin | 294/64.1 |
| 3,314,676 | 4/1967 | Fromm, Jr. | 294/64.1 |
| 3,326,593 | 6/1967 | Farmer et al. | 294/64.1 |
| 3,556,579 | 1/1971 | Seymour-Walker et al. | 294/65 |
| 3,694,020 | 9/1972 | Becker et al. | 294/64.1 |
| 4,635,988 | 1/1987 | Potters et al. | 294/64.1 |

FOREIGN PATENT DOCUMENTS

| | | | |
|---|---|---|---|
| 678020 | 1/1964 | Canada | 294/64.1 |
| 3510719 | 9/1986 | Germany . | |
| 3834866 | 4/1990 | Germany . | |
| 4013065 | 12/1990 | Germany . | |

*Primary Examiner*—Dean Kramer

*Attorney, Agent, or Firm*—Watson, Cole, Stevens, Davis, P.L.L.C.

[57] ABSTRACT

A vacuum lifting plate 1 for board-shaped production pieces that provides a vacuum chamber 8 in connection with a vacuum pump, is sealed against the board-shaped production piece, and includes a suspension arrangement for a hoisting device, includes a base plate 2 with a suspension arrangement and interchangeable sealing ledges 20,22 fastened to the sides of the base plate for fitting to the contour of the production piece.

6 Claims, 3 Drawing Sheets

VACUUM LIFTING PLATE

BACKGROUND OF THE INVENTION

1. Field of the Invention

The invention relates to a vacuum lifting plate for board-shaped production pieces, the vacuum lifting plate providing a vacuum chamber connected to a vacuum pump for sealing against the board-shaped production piece, and a suspension arrangement for a hoisting device.

2. The Prior Art

A small, compact vacuum lifting device for planar materials that can be fixed to a crane is described in German Patent DE-S 40 13 065. The arrangement has a vertical support structure which clasps a rod attached by an eye bolt to the crane hook. The other end of the rod is connected with a suction cushion that works together with the planar material to form a vacuum cheer. An electro-motorized suction pump is attached to a base plate on top of the suction cushion, which is connected with the support structure and connected through a vacuum opening with the vacuum chamber across a one-way ventilation return. A manually operable ventilation for interrupting the vacuum pressure is provided between the suction opening and the one-way ventilation return and the environment. When in operation, the structure fits snugly against the planar materials, whereby the ventilation for interrupting the vacuum pressure is closed. By switching on the motor switch the motor and the suction pump begin to run, so that a suction pressure results through the vacuum chamber and holds the planar material in place on the suction cushion.

In German DE-OS 38 34 866, a vacuum lifting device for planar production pieces such as boards, plates, and planks made out of wood or processed wood is described. This vacuum plate device has at least one suction plate with one or more vacuum chambers with ventilation control for the formation and release of a vacuum in each vacuum chamber. In this way each vacuum chamber is connected to the vacuum plate over a vacuum conduit that has ventilation control placed separately from the vacuum plate on the lifting device, the suction pressure of which is adjustable and the suction pressure adjustment of which can be locked. Each suction conduit is made from a flexible hose assembly connected to a fitting of the vacuum plate chamber at one end and to a straight or angled connection socket of the ventilation control at the other end.

A rubber form for vacuum cross beams for hoisting pipes is known from German DE-OS 35 10 719, whereby the rubber form is pieced endlessly together from individual sections and a rail is mounted on the base piece between two steel legs. The ventilation is largely formed so that the base piece of the section, when seen as a cross-section, consists of an indentation and that the sealing lips, facing outward, are adjacent to a trapezoidal middle section.

The known devices described above are suited to lifting even board-shaped production pieces. Production pieces whose surfaces are not even, for example, production pieces made of corrugated steel, trapezoidal corrugated sheets or similar materials, are not easily lifted with the known lifting devices.

The object of the present invention is to provide a vacuum lifting plate which can lift not only even production pieces, but also production pieces with uneven surfaces which extend in more than one direction, for example, corrugated or trapezoidal corrugated surfaces.

SUMMARY OF THE INVENTION

This object is solved in accordance with the invention wherein a base plate is provided with a suspension arrangement and on the sides of the base plate interchangeable sealing ledges are fastened, these sealing ledges fitting the contour of the production piece.

In this way, a vacuum lift plate is achieved with which production pieces with any type of surface structure can be lifted, whereby the unevenness of the surface structure can be trapezoidal, corrugated or the like, and whereby the unevenness can run in different directions, so that any production piece with an uneven surface of any kind can be lifted.

Practically, each sealing ledge includes a gasket-sealing carrier having openings close to one another on its underside and between them gasket sections which adapt to the contour of the surface of the production piece.

In further arrangements of the invention, a gasket edge is attached around the bottom end of the gasket-sealing carrier. The gasket edge can have multiple sealing lips.

The gasket-sealing carrier can be attached to the base plate by a plug connector, clamp or screw connector to enable the sealing ledge to be replaced by another sealing ledge adapted to lift production pieces with differing surface characteristics.

In further embodiments of the invention, a gasket is provided between the gasket-sealing carrier and the base plate.

Advantageously, multiple setting strips are provided in a certain pattern on the underside of the base plate.

It is further recommended that the vacuum chamber be formed in connection with a vacuum pump between the underside of the base plate and board-shaped production piece.

The gasket-sealing carrier and the gasket edge can consist of various materials, for example, aluminum and plastic, or they can consist of one piece made of, for example, plastic.

The invention will be better understood by the following discussion taken in conjunction with the attached drawings.

DETAILED DESCRIPTION OF THE PREFERRED EMBODIMENTS

Figure 3:
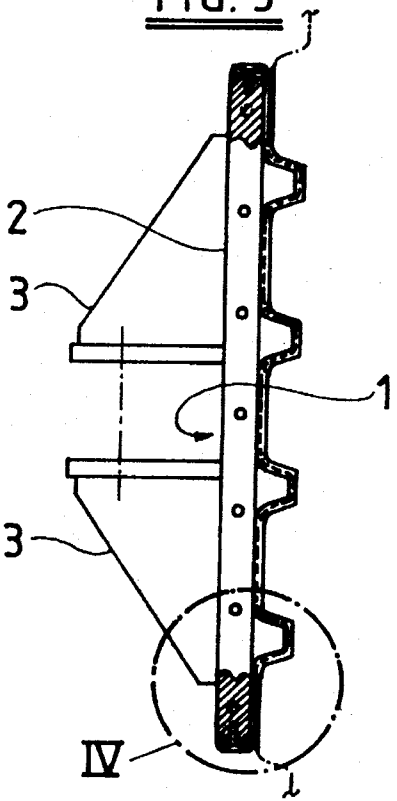
FIG. 3 is a longitudinal cross-section of FIG. 1 as seen along line III—III.
Figure 1:
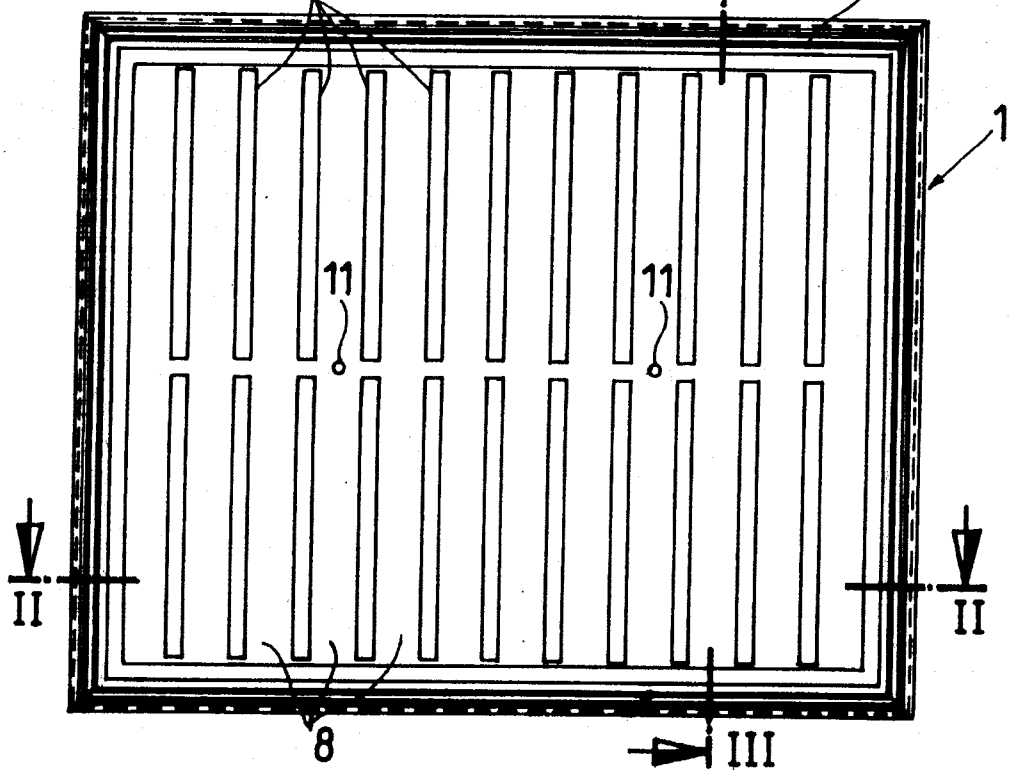
FIG. 1 is a bottom plan view of the vacuum lifting plate.
Figure 2:
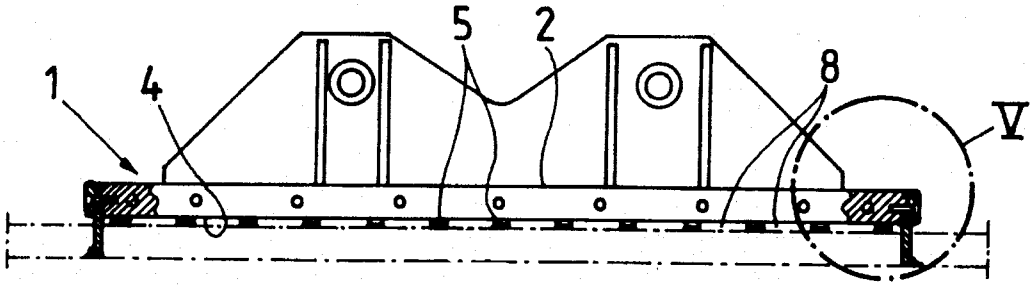
FIG. 2 is a longitudinal cross-section of FIG. 1 as seen along the line II—II.
Figure 4:
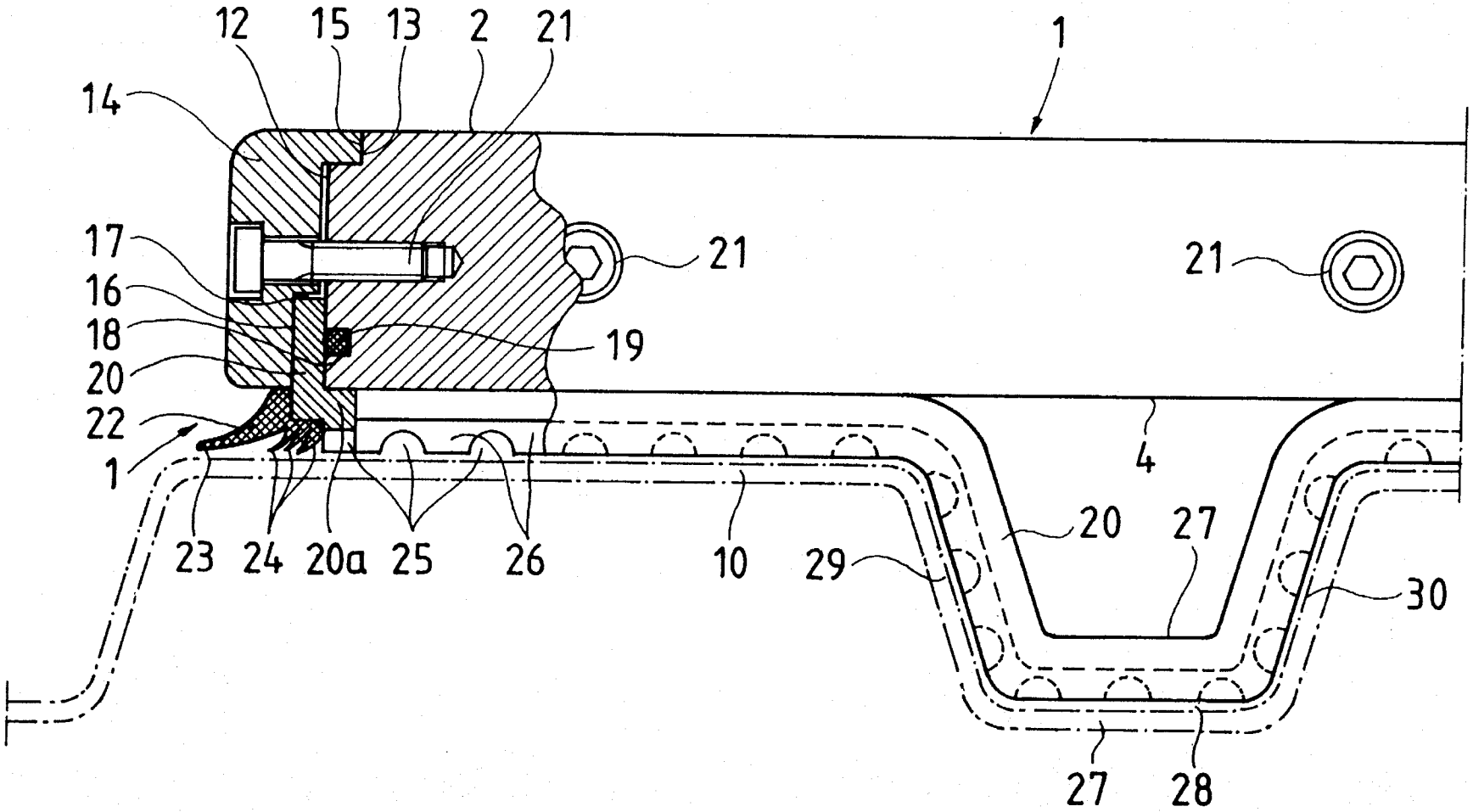
FIG. 4 is an enlarged view of Detail IV in FIG. 3.
Figure 5:
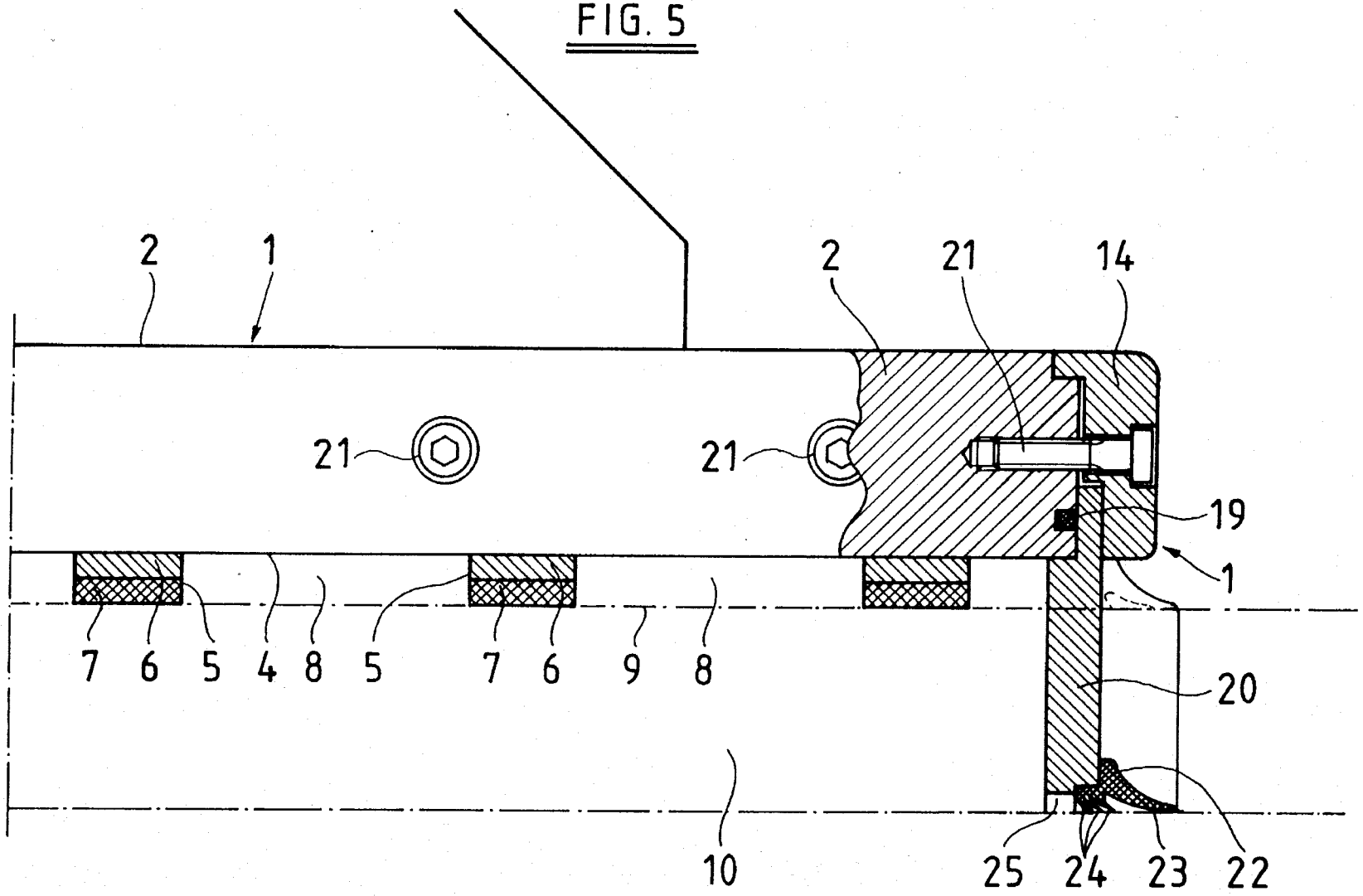
FIG. 5 is an enlarged view of Detail V in FIG. 2.

As can be seen in the figures, the vacuum lifting plate 1 includes a generally rectangular base plate 2 and a suspension arrangement 3 connected to a top side of the base plate, the arrangement 3 enabling the vacuum lifting plate to be lifted, moved, and set down again by a hoisting device. Setting strips 5 are provided in a specific pattern on the underside 4 of the lifting plate, the strips 5 consisting of a metal strip 6 on top and an elastic flexible strip 7 made from a sealing material. The chamber 8 between the underside 4 of the lifting plate 1 and the top edge 9 of a trapezoidal corrugated sheet 10 which is to be handled, represents the vacuum chamber 8. A vacuum is generated in the vacuum chamber 8 through drill holes 11; the chamber returns to normal pressure in the same way.

On the side 12 of the base plate 2 a recess 13 is provided in which a terminal strip 14 engages in a projecting strip 15. The terminal strip 14 has an offset 16 in its lower area, between which and the side surface 12 of the base plate 2 a slit 17 is formed. In the side wall 12 of the base plate 2 a notch 18 is incorporated in the region of the slit 17, in which a gasket 19 is placed.

A gasket-sealing carrier 20 is arranged in the slit 17, which is wedged by the terminal strips 14 by means of several screws 21. On the lower end of the gasket-sealing carrier 20 a gasket edge 22 is provided that has an outer sealing lip 23 and three inner sealing lips 24. In addition, openings 25 with gasket sections 26 between them are provided in the lower region of the gasket-sealing carrier 20.

The gasket-sealing carrier 20 forms together with the gasket edge 22 a sealing ledge 20,22. This sealing ledge 20,22 is exchangeable with other sealing ledges having the same or different dimensions. For lifting several production pieces with several corrugated or trapezoidal corrugated surfaces, it is possible or necessary to exchange one sealing ledge for another sealing ledge.

The gasket-sealing carrier 20 is fitted to the contour of the trapezoidal corrugated sheet 10 in its indentation 27 as well, so that the gasket edge 22, which is arranged on the accordingly extended gasket-sealing carrier 20, fits tightly in the indentation 27 and in the grooves of the trapezoidal corrugated sheet 10, and also against the floor 28 and against both flanks 29,30.

Through the development of the gasket edge 22 of the gasket-sealing carrier 20, it is ensured that the gasket-sealing carrier 20 will rise to the surface of the trapezoidal corrugated sheet 10 with the gasket sections 26. In this way the gasket edge 22 must seal the gasket-sealing carrier against the trapezoidal corrugated sheet 10 at the height of the openings 25 using the pressure in the vacuum chamber 8. Only a sealing function is attributed to the gasket edge 22, while the gaskets and the sealing strips of the known arrangement seal against the production piece as does the pressure of the production piece against the gasket. The latter pressure is unnecessary for the sealing strips in the example developed according to the invention, so that little wear and tear results for the sealing strips used on the lifting plate developed in accordance with the invention and therefore they have a very long life.

I claim:

1. A vacuum lifting apparatus for lifting, lowering and moving workpieces having varying surface contours, said vacuum lifting apparatus comprising:

a base plate defining a top surface, a bottom surface and sides, said base plate including conduit means for supplying vacuum to said bottom surface thereof, suspension means connected to said top surface of said base plate for connecting said base plate to a support apparatus, and a plurality of interchangeable sealing ledges removably attached to the sides of said base plate, said sealing ledges each comprising a circumferential contoured gasket-sealing carrier which projects beyond said bottom surface of said base plate, said contoured carrier including openings between gasket sections thereof, and a profiled gasket lip located outwardly of said gasket sections, said sealing ledges contacting contoured surfaces of corresponding workpieces to be attached to said base plate by application of suction through said conduit means.

2. Vacuum lifting apparatus as in claim 1, wherein each sealing ledge comprises a gasket edge (22) fastened around a lower end of the gasket-sealing carrier (20).

3. Vacuum lifting apparatus as in claim 2, wherein the gasket edge has an edge providing multiple sealing lips.

4. Vacuum lifting apparatus as in claim 1, wherein a gasket is provided between the gasket-sealing carrier (20) and the base plate.

5. Vacuum lifting apparatus as in claim 1, wherein said sealing ledges are interchangeably attached to the base plate by means of a plug connector, clamps or screws.

6. Vacuum lifting apparatus as in claim 1, including multiple setting strips located on said bottom surface of the base plate in a specific pattern.

* * * * *